United States Patent [19]

Schuller

[11] Patent Number: 4,499,985

[45] Date of Patent: Feb. 19, 1985

[54] VENDOR CHANGE RETURN CONTROL

[75] Inventor: James T. Schuller, St. Louis County, Mo.

[73] Assignee: UMC Industries, Inc., Stamford, Conn.

[21] Appl. No.: 422,955

[22] Filed: Sep. 24, 1982

[51] Int. Cl.[3] ..... G07F 5/24

[52] U.S. Cl. ..... 194/10; 194/1 N

[58] Field of Search ..... 194/1 N, 1 M, DIG. 14, 194/10, 4 C, 4 E; 364/464; 133/2

[56] References Cited

U.S. PATENT DOCUMENTS 4,056,181 11/1977 Ikeguchi et al. ..... 194/10

4,286,703 9/1981 Schuller et al. ..... 194/DIG. 14

*Primary Examiner*—Stanley H. Tollberg

*Attorney, Agent, or Firm*—Senniger, Powers, Leavitt and Roedel

[57] ABSTRACT

A change return control for a money handler in a vendor capable of a plurality of customer selectable transactions at different prices, the money handler having circuitry for identifying the denominations of money deposited in the vendor. The control includes circuitry for determining if a coin storage means in the money handler contains first and second predetermined amounts of change, and a vend control for permitting a vend. Logic circuitry determines the amount of credit accumulated as a result of each deposit of money in the vendor, compares the price of a selected transaction with the accumulated credit, and governs the vend control. A vend requiring more than the first predetermined amount of change is allowed only if an item of money of a denomination greater than the amount of change required has been deposited in the vendor. The logic circuitry is responsive to the deposit of an item of money of a first predetermined denomination in the vendor and to the difference between the accumulated credit and the price of the selected transaction being at least as large as the first predetermined denomination to prevent the vend. Display circuitry displays the maximum amount of change that can be returned.

27 Claims, 9 Drawing Figures

VENDOR CHANGE RETURN CONTROL

BACKGROUND OF THE INVENTION

This invention relates to money handling in vendors and more particularly to a change return control for a money handler in a vendor.

A money handler for a vendor which accepts larger denomination moneys without proper control can be misused to function as a money changer. For example, in a vendor permitting transactions costing a nickel which vendor has a money handler which accepts nickels, dimes, quarters and one- through five-dollar bills, a customer wanting change could deposit a nickel plus the bill or coin he wanted changed. If the money handler included one of the current change control systems, the customer would get change for the desired bill or coin. If the bill were a five-dollar bill, for example, this would rapidly deplete the money handler's change bank. One solution to this problem is to not permit a vend if the required change is over a certain amount, say 95¢. But this would unduly restrict the transactions that the vendor would be capable of completing. For example, the customer with only a five-dollar bill would be unable to purchase any item costing less than $4.05. Clearly this is undesirable.

Another disadvantage of present systems in a money handler capable of handling a number of denominations of money concerns the "out of change" light. If the light is set to come on when the difference between the largest acceptable denomination of money and the lowest priced transaction exceeds the change available, many vends for which there is change available will not be made. For example, if the "out of change" light is set to come on when the change bank contains less than $4.95, vends requiring a lesser amount of change, such as 95¢, will not even be attempted. On the other hand, setting the light to come on at 95¢ is misleading. If the change bank contained only $1.00, the money handler could not make change for a five-dollar bill unless the price of the selected transaction was at least $4.00. Clearly such a situation is undesirable since change would not be available to complete most transactions, even though the "out of change" light would not be lit.

SUMMARY OF THE INVENTION

Among the several objects of this invention may be noted the provision of a change return control which returns the customer's money and prevents a vend when the customer is trying to use the money handler as a change maker; the provision of such a control which permits a vend requiring a large amount of change only if a denomination of money greater than the amount of change required has been deposited in the vendor; the provision of such a control which permits a vend requiring a predetermined amount of change only if a predetermined denomination of money, smaller than the predetermined amount of change, has not been deposited in the vendor; the provision of such a control which includes a display which instructs the customer when a transaction can be made requiring change return and the maximum amount of change available before the transaction is attempted; and the provision of such a control which determines if a first amount of change is available in the change bank and if a second, higher amount of change is available in the change bank.

Briefly the change return control of the present invention comprises means for determining if a coin storage means in the money handler contains at least a first predetermined amount of change, and for determining if the coin storage means contains at least a second predetermined amount of change, the second predetermined amount of change being larger than the first amount. A vend control, for permitting a vend, and logic means are also included in the change return control. The logic means determines the amount of credit accumulated as a result of each deposit of money in the vendor, compares the price of a selected transaction with the accumulated credit, and governs the vend control. A vend requiring more than the first predetermined amount of change is allowed only if an item of money of a denomination greater than the amount of change required has been deposited in the vendor.

In a second aspect, the change return control comprises a vend control for permitting a vend, and logic means. The logic means determines the amount of credit accumulated as a result of each deposit of money in the vendor, compares the price of a selected transaction with the accumulated crcdit, and governs the vend control. The logic means is responsive to the deposit of an item of money of a first predetermined denomination in the vendor and to the difference between the accumulated credit and the price of the selected transaction being at least as large as the first predetermined denomination to prevent the vend control from permitting a vend.

In a third aspect, the change return control includes means for determining if the coin storage means contains at least a first predetermined amount of change and for determining if the coin storage means contains at least a second predetermined amount of change, and display means for displaying to the customer the maximum amount of change that can be returned. The display means is responsive to the coin storage means containing at least the first predetermined amount of change but less than the second predetermined amount to display the first predetermined amount as the maximum amount of change that can be returned.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
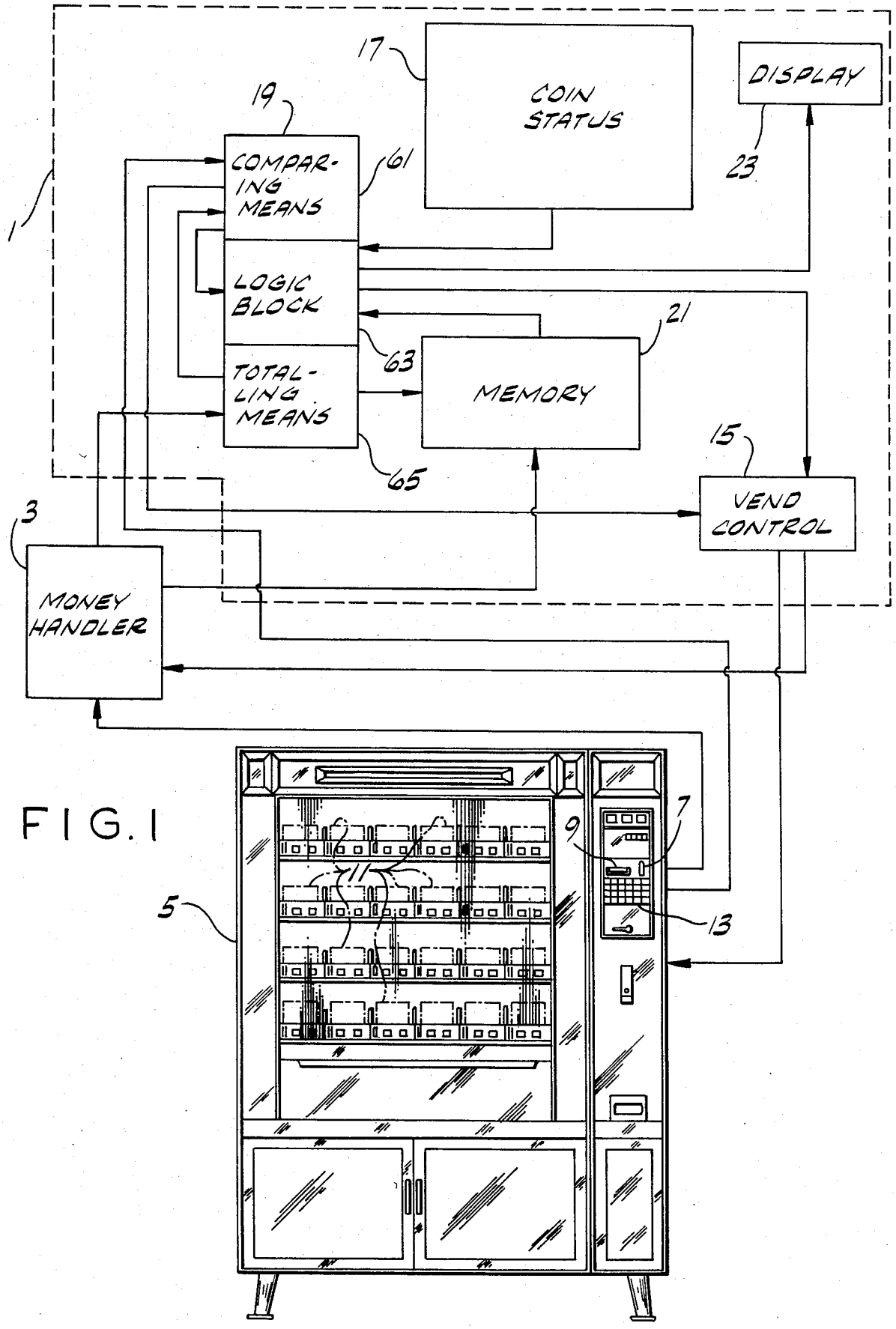
FIG. 1 is a front elevation of a vendor with various internal parts thereof and the change return control of this invention shown connected thereto in block-diagrammatic form.

Referring now to the drawings, there is shown in FIG. 1 a change return control 1 for a money handler 3.

The change return control and the money handler are shown as outside the cabinet of a vendor 5 for clarity, but it is understood that in actuality both are contained inside the vendor. The money handler is capable of accepting nickels, dimes, quarters and dollar coins via a coin slot 7 and dollar bills, five-dollar bills and ten-dollar bills via a bill slot 9. The vendor contains a plurality of items or transactions 11 at different prices, which items are customer selectable by means of a matrix of selection switches 13.

Control 1 includes a vend control 15 for permitting a vend, a coin status determining means 17, and a logic means 19. The vend control is a relay which when actuated permits the vend to proceed by, for example, supplying power to the vending machine. Of course vend control 15 need not be a relay; any apparatus under the control of logic means 19 which permits a vend upon command of the logic means may be used.

Control 1 also includes a memory 21 and a display 23. In general the memory is used to keep track of whether certain denominations of money have been deposited in the vendor and to store the customer's accumulated credit figure. The purpose of the display is to display to the customer the maximum amount of change return before he attempts a transaction.

The money handler comprises a coin handler 25 (see FIG. 2) and a bill validator (not shown). The coin handler is conventional in design. It rejects slugs and sorts any valid nickels, dimes, quarters and dollar coins inserted into coil slot 7 into the proper one of four coin chutes, each designated by the reference numeral 27. Each coin chute leads to its respective self-replenishing change tube, i.e., to a nickel change tube 29, a dime change tube 31, a quarter change tube 33, and a dollar coin change tube 35. Collectively the change tubes are a change bank which constitutes means for storing coins for use as change. Of course, this system could also function using fewer or more than four change tubes. Coins and bills other than those mentioned above can also be used. As a coin falls through its respective chute, it is sensed by an optoelectronic sensor assembly 37 associated with that chute. Since each sensor 37 is associated with a single coin tube, the sensing of a coin by a particular sensor identifies the denomination of that coin. Similarly, the bill validator has outputs (not shown) which uniquely identify the denomination of a one-, five- or ten-dollar bill inserted in bill slot 9. Thus, sensors 37 and the above mentioned outputs of the bill validator constitute means for identifying the denominations of money deposited in the vendor. The means for identifying the denominations of items of money deposited in the vendor are not shown in detail since several are well-known in the art.

After a coin has passed its sensor 37, it either falls into its coin tube (when the tube needs coins) or is deflected into a cash box (when the tube is full) by a standard mechanism, such as a solenoid (not shown), disposed above the tube. Each coin tube has an ejector 39, which ejects coins from that tube as needed for change. Ejectors 39 collectively constitute means for issuing coins from the money handler's change storage means in change in different amounts. Such ejectors are well known in the art.

The nickel change tube has an optoelectronic sensor assembly 41 disposed along that tube at a position where it senses if the tube contains at least four nickels. If the fourth nickel is present in the tube, sensor 41 detects that the light path across the nickel change tube has been blocked and signals the presence of the fourth nickel. The quarter change tube has an optoeletronic sensor assembly 43 disposed on that tube at a position where it senses if at least three quarters are present in the quarter change tube. Together sensors 41 and 43 constitute means for determining if the change tubes (i.e. the coin storage means) contains at least 95¢, which is a first predetermined amount of change. This predetermined amount of change is chosen to enable the money handler to make change for any transaction costing between 5¢ and $1.00 upon insertion of a dollar or smaller denomination item of money into the vendor. Of course, sensors 41 and 43 can also be disposed higher up on their respective change tubes to, e.g., facilitate their mounting. The first predetermined amount of change is selected to take into account the lowest-price of a transaction in the vendor, the type of coins available as change, and the denominations of money acceptable by the money handler. This amount, therefore, varies from vendor to vendor; the amount 95¢ is used only as an example. Higher up on the quarter change tube, e.g. at the position of the nineteenth quarter, is another optoelectronic sensor assembly 45, which together with sensor 41 constitutes means for determining if the change tubes contain at least a second predetermined amount of change, in this case $4.95. This amount also varies from vendor to vendor in accordance with the guidelines set forth above.

The dollar change tube has an optoelectronic sensor assembly 47 disposed at a position where it senses if four dollars are present in the change tube and an optoelectronic sensor assembly 49 disposed to sense if nine dollars are present. Sensor 49, therefore, constitutes means for sensing if at least nine dollar coins are present in the dollar coin tube. Sensors 47, 43 and 41 constitute means for determining if the change tubes contain at least $4.95, while sensors 49, 43 and 41 constitute means for determining if the change tubes contain at least $9.95, a third predetermined amount of change. This third predetermined amount also varies from vendor to vendor. If the money handler does not accept ten-dollar bills, sensor 49 is normally omitted. If, on the other hand, the money handler also accepts twenty-dollar bills, an additional optoelectronic sensor assembly (not shown) is disposed on the dollar change tube at the position of the nineteenth dollar, which sensor in conjunction with sensors 43 and 41 determines if there is at least $19.95 in the change tubes.

Figure 3:
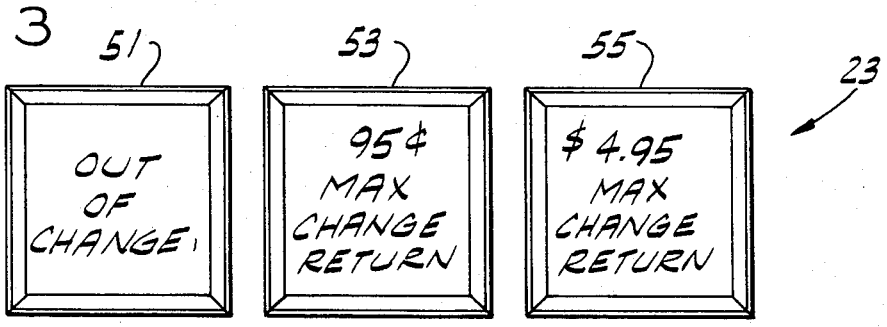
FIG. 3 is a front elevation of a display used in this invention.

Display 23 includes three readouts 51, 53 and 55 (FIG. 3) which constitute means for displaying to the customer the maximum amount of change that can be returned, as well as an additional readout (not shown) bearing the legend "Insert nickels, dimes, quarters, one dollar bills, five-dollar bills and ten-dollar bills . . . Correct change returned." This latter readout is illuminated when the change tubes contain at least the third predetermined amount of change. Readout 51 is illuminated when the change tubes contain less than 95¢, readout 53 is illuminated when the change tubes contain at least 95¢ but less than $4.95, and readout 55 is illuminated when the change tubes contain at least $4.95 but less than $9.95. Actually, saying that the change tubes contain less than a certain amount, e.g. 95¢, is just a shorthand way of saying that the sensors which sense coins at the levels which make up that amount are not all sensing coins. Whether or not the change tubes actually have some combination of coins, e.g. ten dimes, that exceeds the desired amount is irrelevant; what is important is that the change be available in the proper kinds and number of coins to make change under the specified condition. Of course, only one readout is illuminated at a time. Any conventional method of illuminating these readouts may be used.

Figure 3A:
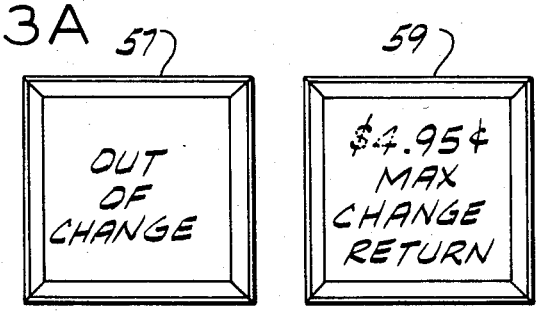
FIG. 3A is a front elevation of a display alternative to that shown in FIG. 3.

As an alternative to readouts 51, 53 and 55, display 23 comprises two readouts 57 and 59 (FIG. 3A) which replace readouts 51, 53 and 55. Readout 57 is identical to readout 51. Readout 59, however, is capable of displaying 95¢ and $4.95 as the maximum change return. If 95¢ is available as change but $4.95 is not, readout 59 displays "95¢" as the maximum change return. If $4.95 is available but $9.95 is not, this same readout displays $4.95 as the maximum change return.

Figure 4:
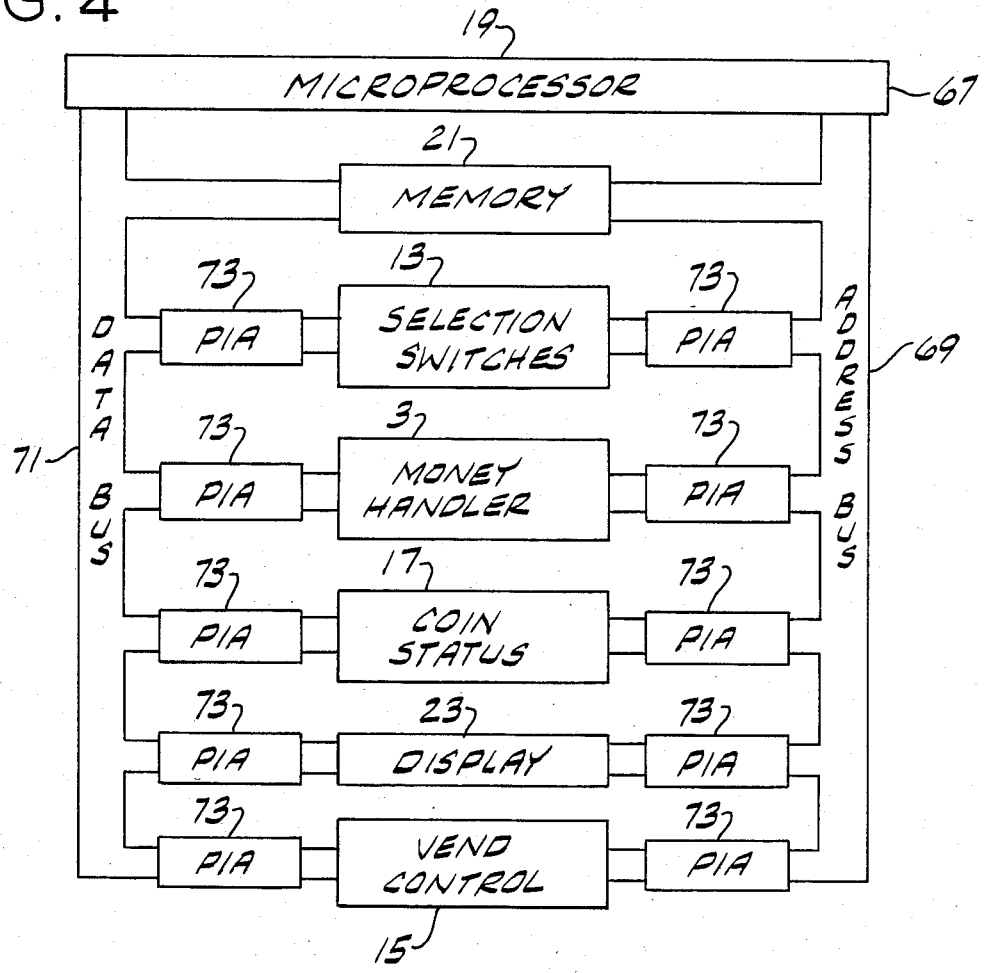
FIG. 4 is a block diagram of the circuitry of this invention.

Logic means 19 performs various functions as is indicated on FIG. 1 by dividing it into three segments, a comparing means segment 61, a logic block 63, and a totalling means 65. Totalling means 65 uses signals from the money handler identifying the denominations of items of money deposited in the vendor to determine the amount of credit accumulated as a result of each such deposit. Comparing means 61 compares the price of a selected transaction with the accumulated credit. And the logic block governs the vend control according to a given set of rules, set forth below, in response to inputs from coin status determining means 17, memory 21, money handler 3, and comparing means 61. Of course, comparing means 61, logic 1 block 63 and totalling means 65 can be totally distinct circuits, each containing many discrete components, but applicant prefers to embody all three in a microprocessor 67 (FIG. 4) suitably programmed to perform the required functions. Thus, microprocessor 67 constitutes logic means 19.

The microprocessor is, e.g., a Motorola M6800-type which addresses its peripherals, i.e., the selection switches, the money handler, the coin status determining means, and the vend control, over an address bus 69. Data is transmitted between the peripherals and the microprocessor over a data bus 71. Each peripheral has a peripheral interface adapter (PIA), designated collectively by the reference numeral 73, interconnected between it and the address bus and between it and the data bus. The memory is directly connected to the address bus and the data bus. For a detailed circuit diagram of a microprocessor-based system similar to the one described above see coassigned application Ser. No. 422,959, filed Sept. 24, 1982. For further information concerning the M6800 microprocessor and compatible hardware, see M6800 Microcomputer System *Design Data* from Motorola, Inc. (1976).

The flowchart of the program for the microprocessor is shown in FIGS. 5, 6A, 6B, and 7. In this flowchart the following abbreviations are used for convenience: "N" means determine whether the nickel change tube contains at least four nickels, "Q1" means determine whether the quarter change tube contains at least three quarters, "Q2" means determine whether the quarter change tube contains at least nineteen quarters, "D1" means determine whether the dollar change tube contains at least four dollar coins, "D2" means determine whether the dollar change tube contains at least nine dollar coins, and "DIFF" means difference. With this flowchart one of ordinary skill in the art can easily write a program corresponding thereto in the language of the particular microprocessor he or she is using. It should be understood that when the microprocessor also governs other functions of the vendor besides change return control this flowchart is only a part of the complete flowchart used in programming the microprocessor.

Figure 5:
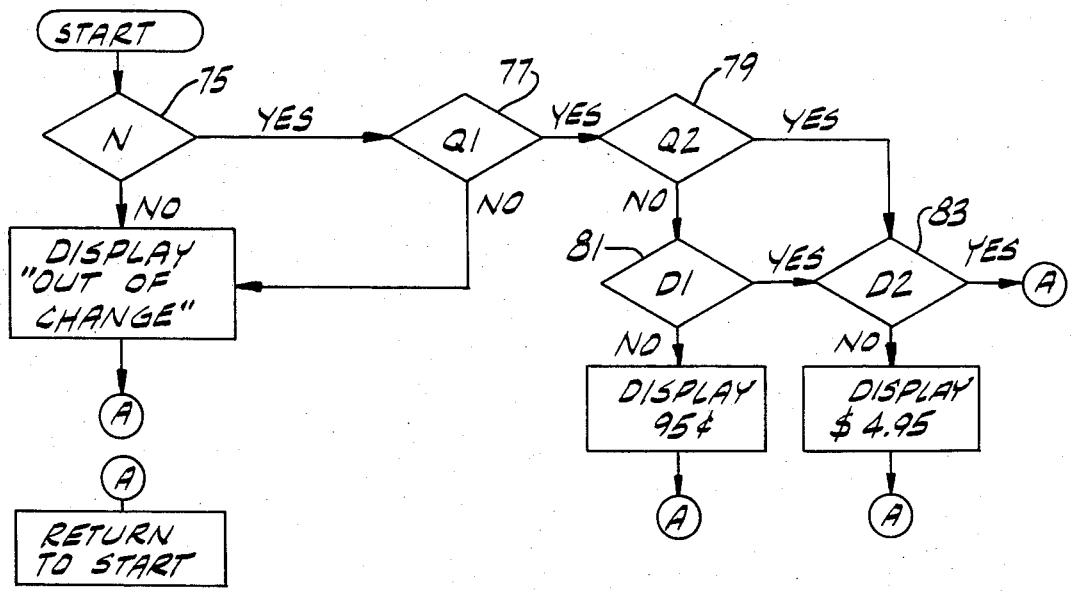
FIGS. 5, 6A, 6B and 7 are the flowchart for a microprocessor used in this invention.

The operation of the change return control is as follows:

The microprocessor's standby loop is a display subroutine shown schematically in FIG. 5. The microprocessor's first step in that subroutine is to test sensor 41 (FIG. 2), which is part of coin status determining means 17, to determine if at least four nickels are present in the nickel change tube. This step is shown schematically by decision box 75. The microprocessor tests any of sensors 41, 43, 45, 47 and 49 by addressing the coin status determining means over the address bus and reading the data from the desired sensor over the data bus. If at least four nickels are not present in the nickel change tube, the money handler cannot even return change when a quarter has been inserted to purchase a 5¢ item or transaction, so the microprocessor activates display 51 to display the message "OUT OF CHANGE" by addressing the display means over the address bus and sending the signal required to activate the "OUT OF CHANGE" display to the display means over the data bus. One of ordinary skill in the art would have no trouble in activating the proper display of the display means. After the message "OUT OF CHANGE" has been displayed, the microprocessor returns to the beginning of the standby loop and repeats the above steps. Thus, until additional nickels are added to the nickel change tube, the display "OUT OF CHANGE" remains on.

Figure 2:
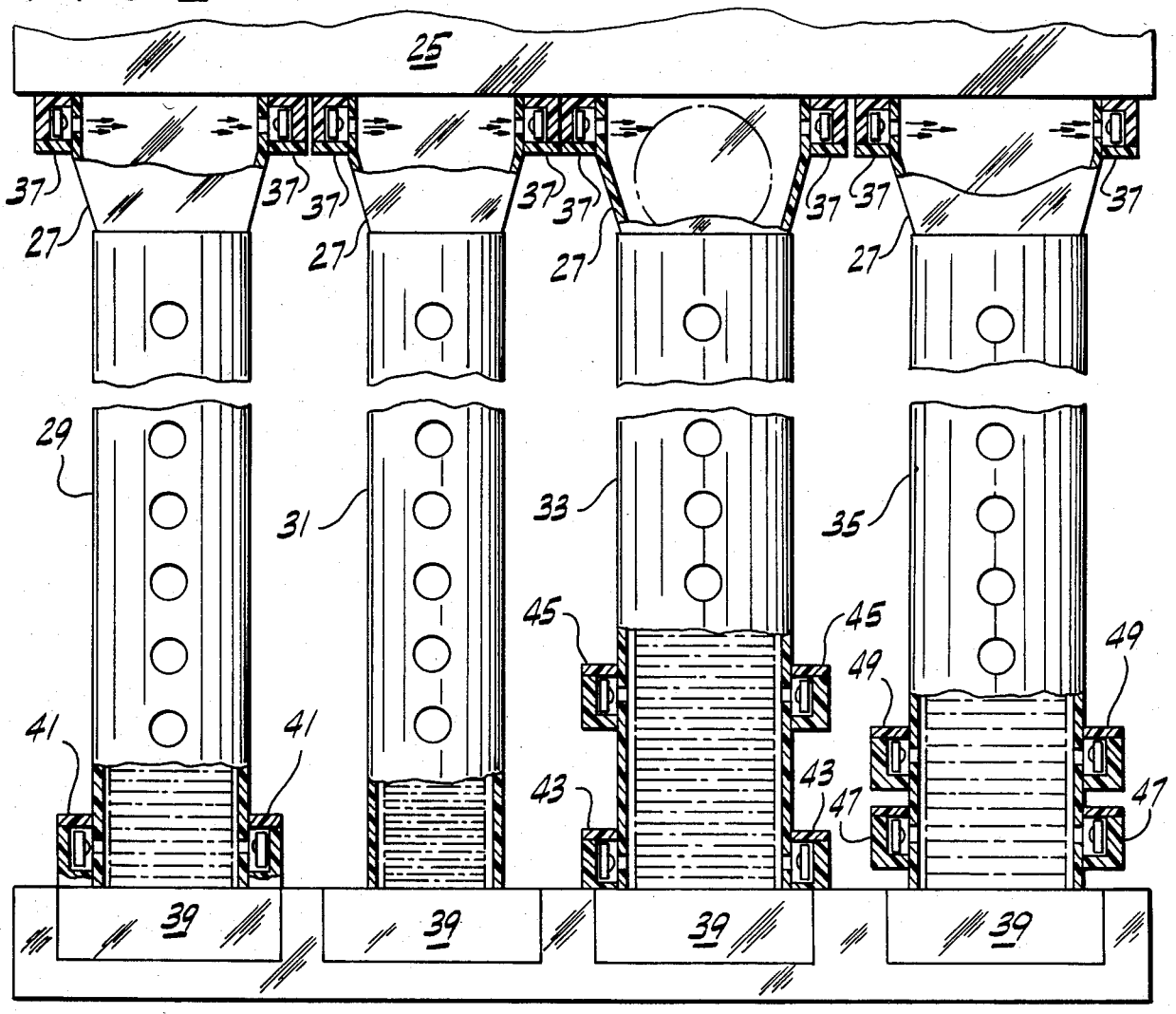
FIG. 2 is a front elevation of a portion of a coin handler and a plurality of change tubes showing sensors on the change tubes used in this invention.

If there are at least four nickels present, the microprocessor's next step after decision box 75 is a decision box 77 where it determines if at least three quarters are present in the quarter change tube. It does this by testing sensor 43 (FIG. 2). If there are not at least three quarters in the quarter change tube, the money handler cannot return proper change when a dollar has been inserted to purchase a 5¢ item, so the microprocessor again activates display 51 to display the message "OUT OF CHANGE". Of course, it would be a simple matter for one of ordinary skill in the art who wanted to add a display for indicating when only nickels could be returned in change to have the microprocessor display at this point "20¢ MAX CHANGE RETURN". If the microprocessor determines at least three quarters are present, it means that there is at least 95¢ (four nickels plus three quarters) available as change. It then moves to a decision box 79 where it determines if at least nineteen quarters, i.e. $4.75, are present in the quarter change tube. This is accomplished by the microprocessor testing sensor 45. If there are not nineteen quarters present, the microprocessor moves to a decision box 81 where it determines if at least four dollars are present in the dollar change tube by testing sensor 47. Of course if the microprocessor determines that either nineteen quarters or four dollars are present in the respective change tubes, there is at least $4.95 available as change. If there are not four dollars in the dollar change tube at this point, however, there is less than $4.95 available as change and the microprocessor activates display 53 to display the message "95¢ MAX CHANGE RETURN". That is, the display means is responsive to the change tube containing at least 95¢ but less than $4.95 to display 95¢ as the maximum amount of change that can be returned.

If the answer in decision box 81 is yes, the microprocessor moves to a decision box 83 where it determines if at least nine dollars are contained in the dollar change tube by testing sensor 49. If, when the microprocessor had tested sensor 45, it had determined that there were nineteen cuarters present, it would have moved directly from decision box 79 to decision box 83. If sensor 49 indicates that there are nine dollars present in the dollar change tube, the change tubes contain at least $9.95 available as change and the microprocessor returns to the beginning of the standby loop without activating display 51, 53 or 55. On the other hand, if there are not nine dollars present, the change tubes contain at least $4.95 but less than $9.95 available as change, so the microprocessor activates display 55 to display the message "$4.95 MAX CHANGE RETURN." That is, the display means includes means, i.e. display 55, for displaying $4.95 as the maximum amount of change that can be returned if the change tubes contain at least $4.95 but less than $9.95.

When a customer deposits money in the vendor, this generates an interrupt signal that takes the microprocessor out of its standby loop. For further detail on the above or the following, see the aforementioned coassigned aoolication. The microprocessor in its interrupt sequence (FIGS. 6A, 6B and 7) first goes to a decision box 85 to determine if a nickel generated the interrupt. This determination is made by checking to see if the sensor 37 disposed above the nickel tube had detected a coin. This sensor, like the other sensors 37, is part of the money handler and is thus addressed over bus 69 and read over bus 71. If a nickel generated the interrupt, the microprocessor adds 5¢ to the customers' accumulated credit, which previously was zero, and stores this figure in memory. That is, the microprocessor includes means, namely address bus 69 and data bus 71, for storing and updating an accumulated sales figure in memory. The accumulated sales figure is stored in a predetermined location in the memory, and it is this location that the microprocessor addresses over the address bus and updates over the data bus every time another item of money is deposited in the vendor. The microprocessor then returns to the standby loop.

If the item of money deposited was not a nickel, the microprocessor checks the money handler to see if it was a dime. If so, 10¢ is added to the customer's accumulated credit figure in memory and the microprocessor returns to the standby loop. If not, the microprocessor goes on to check for the deposit of a quarter. The above process continues through quarters, dollar coins and bills, five-dollar bills and ten-dollar bills, the accumulated credit figure being updated by an amount corresponding to the denomination of the item of money deposited. Additionally, when the microprocessor determines that an item of money of a first predetermined denomination, e.g. a dollar, has been deposited in the vendor it stores this information in the memory. Specifically, if a dollar has been deposited, the microprocessor sets a buffer designated by the reference characters "DOLLAR" equal to 1. As a consequence, whenever the microprocessor subsequently must determine if a dollar has been deposited in the vendor it simply reads the buffer DOLLAR in memory. If the value of DOLLAR is 1 then a dollar has been deposited. If it is 0 then a dollar has not been deposited. Of course, the microprocessor could just as easily keep track of whether a quarter, or any other denomination of money, has been deposited in the vendor. If a five-dollar bill has been deposited in the vendor, the microprocessor sets a buffer FIVE in memory equal to 1 and if a ten-dollar bill has been deposited it sets a buffer TEN in memory equal to 1. In all instances, after updating the customer's accumulated credit and setting the corresponding buffers, if any, equal to 1, the microprocessor returns to its standby loop. Of course, the above-described system could also be easily modified to also accommodate the deposit of twenty-dollar bills if desired.

Figure 6A:
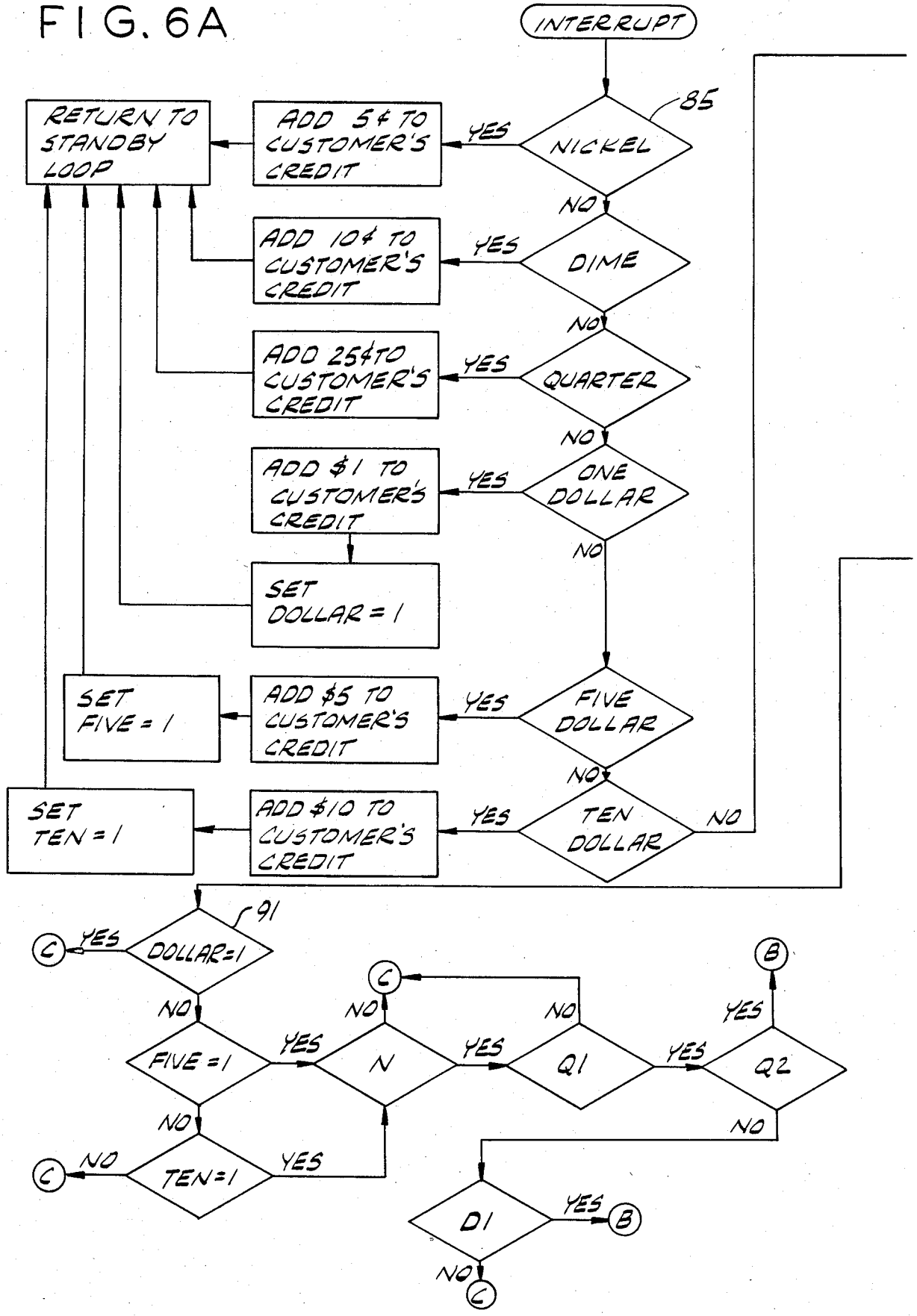
Figures 6B, 7:
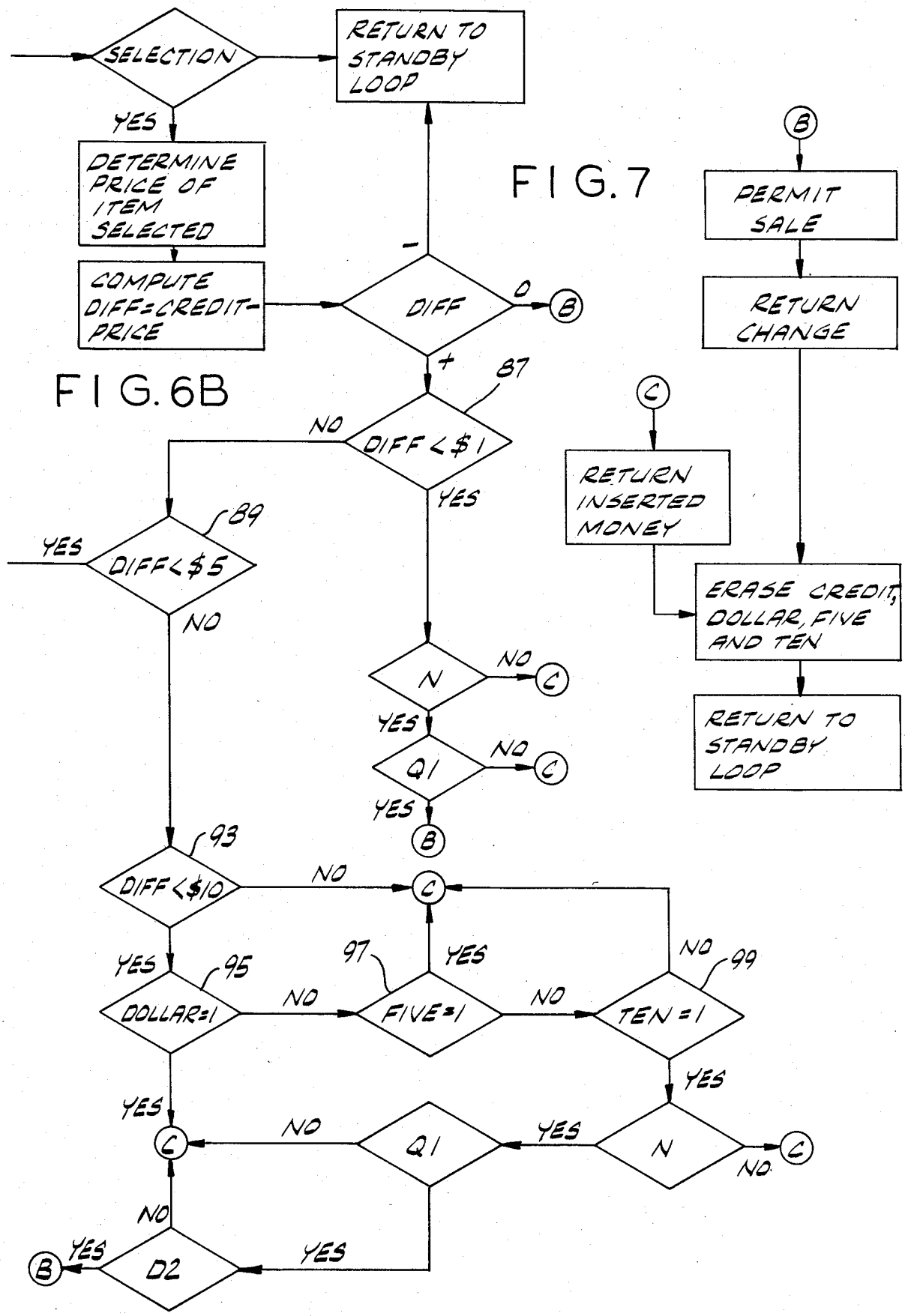

If the interrupt was not generated by the deposit of an item of money, the microprocessor, after fruitlessly checking to see if a ten-dollar bill was the cause of the interrupt, checks to determine if it was a selection interrupt (FIG. 6B).

As is explained in detail in the aforementioned coassigned application, a selection interrupt is generated by the customer pressing any one of the selection switches. If the interrupt was not a selection interupt, the microprocessor retuens to the stanby loop to await further interrupts. If the interrupt is a selection interrupt, the microprocessor reads the selection switches to determine which one was pressed and then reads the memory to determine the price of the item or transaction selected. This procedure is explained in detail in the aforementioned coassigned application.

Once the price of the selected transaction is determined, the difference between the customer's accumulated credit and the price is computed by the microprocessor. If this difference is negative, i.e. if the price exceeds the accumulated credit, no vend is allowed, since the customer has not deposited enough money. The microprocessor under these conditions simply returns to the standby loop. If the difference equals zero, on the other hand, which means that the customer has inserted the correct change for the transaction selected, the microprocessor branches to a point B in the program. From point B (FIG. 7), the microprocessor first permits the vend, i.e. by addressing vend control 15 on the address bus and by signalling said vend control on the data bus to permit the vend by, e.g., closing a master relay. Next the microprocessor returns any change due the customer. In this case, of course, the customer is due no change. Then the microprocessor erases the accumulated credit figure and the buffers DOLLAR, FIVE and TEN in memory by addressing those respective locations in memory over the address bus and using the data bus to erase the contents of those locations. Thus, upon completion of a vend the microprocessor erases the customer's accumulated credit figure. The microprocessor then returns to the standby loop.

If the difference between the customer's accumulated credit and the price of the selected item is positive rather than negative or zero as described above, the customer has inserted more money than required. In this case, the microprocessor proceeds, after determining that the difference is positive, to a decision box 87 (FIG. 6B) where it determines if the difference is less than one dollar. If the difference is less than one dollar, the microprocessor then determines, in the same way as in the standby loop described above, whether the nickel change tube contains at least four nickels and whether the quarter change tube contains at least three quarters. If either of these conditions is not met, the change tubes do not contain 95¢ available as change and the vend is not permitted. Microprocessor 67 jumps immediately to a point C in the program, the first step of which (FIG. 7) is to return all the money deposited. This process is described in detail in the aforementioned coassigned application. Briefly, this system makes change and returns the customer's money by addressing the respective coin ejector 39 of the desired change tube, which ejectors are part of the money handler, and signalling that ejector over the data bus to eject a coin. This process is repeated as necessary until the desired number of the desired types of coins have been returned to the customer. The actual bills inserted by the customer are also returned at this step. After returning the customer's money, the microprocessor erases his credit as well as the buffers DOLLAR, FIVE and TEN and returns to the standby loop. Thus, microprocessor 67 also erases the customer's credit upon return of his money.

If on the other hand, after leaving decision box 87, the microprocessor finds that there is 95¢ available as change it jumps to point B (FIG. 7), where it permits the sale, returns the customer's change, erases the credit figure and the buffers DOLLAR, FIVE and TEN in memory and returns to the standby loop, all as described above. Thus, microprocessor 67 constitutes controlling means which permit a vend if the change bank contains at least 95¢ and if the difference between the accumulated credit and the price of the selected transaction is no greater than 95¢ irrespective of whether the coin tubes contain $4.95 available as change.

When the customer has exceeded the price of the transaction by at least a dollar, the answer to decision box 87 is NO and the microprocessor branches to a decision box 89 in which it determines if the difference between the customer's credit and the price of the selected transaction is less than five dollars. If the difference is less than five dollars, the microprocessor branches to a decision box 91 (FIG. 6A) where it determines if a dollar has been deposited in the vendor by reading the buffer DOLLAR in memory. If DOLLAR=1, a dollar has been deposited and the customer is trying to get change for his dollar. Since the change due the customer under these circumstances is between one dollar and $4.95, the customer who has inserted a dollar bill or coin has inserted an item of money, the dollar, into the vendor for no apparent purpose except to obtain change for it. Permitting this would rapidly deplete the change bank, so if DOLLAR=1, the microprocessor branches to point C (FIG. 7) where all the customer's money is returned and the vend is not permitted. Thus, the microprocessor is responsive to the deposit of a dollar, which is a first predetermined denomination, into the vendor and to the difference between the accumulated credit and the price of the selected transaction being greater than 95¢ to prevent a vend.

When DOLLAR does not equal 1, the microprocessor examines the buffer FIVE to see if a five-dollar bill has been deposited in the vendor. If one has not, it checks the buffer TEN to see if a ten-dollar bill has been deposited. If a ten-dollar bill has not been deposited either, that means the customer is due at least a dollar in change but he has only deposited nickels, dimes and quarters into the vendor. It is undesirable to permit a vend under these circumstances so the microprocessor branches to point C to return the customer's money in full. Thus, the microprocessor prevents a vend if the difference between the accumulated credit and the price of the selected transaction is at least a dollar and no five or ten-dollar bills have been deposited in the vendor. If either FIVE or TEN do equal 1 then the customer is not misusing the money handler and the microprocessor next checks to see if it has $4.95 available as change. If either the nickel tube does not contain at least four nickels or the quarter tube does not contain at least four quarters, change cannot be made and the microprocessor branches to point C to return the customers' money. If these conditions are met, however, the microprocessor then determines if either the quarter tube contains nineteen quarters or the dollar tube contains four dollars. If either is the case the change tubes contain at least $4.95 available as change, so the microprocessor jumps to point B to allow the vend and to return the customer's change. If neither is the case, there is not $4.95 available as change, so the microprocessor jumps to point C to return the customer's money. Thus, a vend requiring more than 95¢ in change is allowed by the microprocessor only if at least a five dollar bill, i.e. an item of money of a denomination greater than the amount of change required, has been deposited in the vendor. Note that in these circumstances the microprocessor does not also determine if the change tubes contain $9.95 available as change. The microprocessor allows a vend if the coin tubes contain at least $4.95 and if the difference between the accumulated credit and the price of a selected transaction is no greater than $4.95 irrespective of whether the change tubes contain $9.95 available as change.

When the customer has deposited at least five dollars more in the vendor than the price of the selected transaction, the answer to decision box 89 is NO and the microprocessor branches to a decision box 93 (FIG. 6B) where it determines if the difference between the customers credit and the price of the selected transaction is less than ten dollars. If the answer to decision box 93 is NO, the microprocessor jumps to point C to return the customer's money since there is no legitimate reason in a vendor which only accepts monies up to ten-dollar bills why the accumulated credit should exceed the price of the selected transaction by ten dollars or more. That is, microprocessor 67 constitutes means responsive to the difference between the accumulated credit and the price of the selected transaction being at least $10 to prevent a vend.

When, on the other hand, the difference between the accumulated credit and the price of the selected transaction is at least five dollars but less than ten dollars, the microprocessor branches from decision box 93 to a decision box 95. In decision box 95 the microprocessor determines whether a dollar has been deposited in the vendor by seeing if the buffer DOLLAR=1. If so, since at least five dollars is due the customer in change, the customer is misusing the money handler. Accordingly the microprocessor aborts the vend process by jumping to point C where it returns the customer's money. If DOLLAR does not equal one, on the other hand, the microprocessor branches to a decision box 97 where it determines if a five-dollar bill has been deposited in the vendor by examining the buffer FIVE. If FIVE=1, a five-dollar bill has been deposited in the vendor. Since, however, the customer is due at least that much change, the customer is again misusing the money handler. The microprocessor, therefore, branches to point C if FIVE=1 to return all the customer's money. Thus, the microprocessor is responsive to the deposit of a five-dollar bill, i.e. a second predetermined denomination larger than the first predetermined denomination, for preventing the vend control from permitting a vend if the difference between the accumulated credit and the price of the selected transaction is at least $5.00.

When the answer to decision box 97 is NO, the microprocessor branches to a decision box 99 where it determines if a ten-dollar bill has been deposited in the vendor by examing the buffer TEN. If a ten-dollar bill has not been deposited in the vendor, the microprocessor jumps from decision box 99 to point C to return all the customer's money because the customer has over-inserted at least $5.00 in money, all of which is less than a dollar in denomination. The customer is obviously trying to replace his coins with the ones in the coin tubes. Thus, the microprocessor allows a vend requiring more than $4.95 change only if a ten-dollar bill has been deposited in the vendor.

If the answer to decision box 99 is YES, the microprocessor then determines if the following conditions are all met: the nickel tube contains at least four nickels, the quarter tube contains at least three quarters and the dollar tube contains at least nine dollars (this last is determined by checking sensor 49). If all three of these conditions are met, the microprocessor jumps to point B to allow the vend and return the customer's change. If any one is not met, the jump is to point C and where customer's money is returned.

As an alternative, if sensor 47 were set to detect the fifth coin rather than the fourth coin in the dollar tube, the microprocessor could permit a vend if the quarter tube contained at least nineteen quarters and the dollar tube contained at least five dollars, assuming the nickel tube contained at least four nickels, even if the dollar tube did not contain nine dollars, since the maximum amount of change of $9.95 could be made using the nineteen quarters and the five dollars. Likewise, such an arrangement of sensor 47 would permit an alternative path for the microprocessor to follow in determining the maximum amount of change to display.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A change return control for a money handler in a vendor capable of a plurality of customer selectable transactions at different prices, said money handler having means for identifying the denomination of items of money deposited in the vendor, means for storing coins for use as change and means for issuing coins from the storage means in change in different amounts, comprising:

means for determining if the coin storage means contains at least a first predetermined amount of change, and for determining if the coin storage means contains at least a second predetermined amount of change, said second predetermined amount being larger than said first amount;

a vend control for permitting a vend;

logic means for determining the amount of credit accumulated as a result of each deposit of money in the vendor, for comparing the price of a selected transaction with the accumulated credit, and for governing said vend control, said means allowing a vend requiring more than the first predetermined amount of change only if an item of money of a denomination greater than the amount of change required has been deposited in the vendor;

wherein the coin storage means includes a plurality of change tubes, wherein the amount of change determining means includes first sensing means for sensing the presence of the first predetermined amount of change and second sensing means for sensing the presence of the second predetermined amount of change;

wherein the first sensing means includes a first optoelectronic sensor assembly and the second sensing means includes a second optoelectronic sensor assembly; and wherein the first predetermined amount of change is 95¢ and the second predetermined amount of change is $4.95, wherein the coin storage means includes a nickel change tube and a quarter change tube, wherein the first sensor assembly is disposed on the quarter change tube at a position where it senses if at least three quarters are present in the quarter change tube, and wherein the first sensing means also includes an optoelectronic sensor assembly disposed on the nickel change tube at a position where it senses if at least four nickels are present in the nickel change tube.

2. A change return control as set forth in claim 1 wherein the second sensor assembly is disposed on the quarter change tube at a position where it senses if at least nineteen quarters are present in the quarter change tube.

3. A change return control as set forth in claim 2 wherein the coin storage means includes a dollar change tube, further including an optoelectronic sensor assembly disposed on the dollar change tube at a position where it senses if at least four dollars are present in the dollar change tube.

4. A change return control as set forth in claim 1 wherein the coin storage means includes a dollar change tube and wherein the second sensor assembly is disposed on the dollar change tube at a position where it senses if at least four dollars are present in the dollar change tube.

5. A change return control for a money handler in a vendor capable of a plurality of customer selectable transactions at different prices, said money handler having means for identifying the denomination of items of money deposited in the vendor, means for storing coins for use as change and means for issuing coins from the storage means in change in different amounts, comprising:

means for determining if the coin storage means contains at least a first predetermined amount of change, and for determining if the coin storage means contains at least a second predetermined amount of change, said second predetermined amount being larger than said first amount;

a vend control for permitting a vend;

logic means for determining the amount of credit accumulated as a result of each deposit of money in the vendor, for comparing the price of a selected transaction with the accumulated credit, and for governing said vend control, said means allowing a vend requiring more than the first predetermined amount of change only if an item of money of a denomination greater than the amount of change required has been deposited in the vendor; and a memory for storing the information that an item of money of a first predetermined denomination has been deposited in the vendor, said memory being responsive to the identifying means.

6. A change return control as set forth in claim 5 wherein the logic means includes means for storing and updating an accumulated credit figure in the memory and for erasing said credit figure upon completion of a vend and upon return of the customer's money.

7. A change return control for a money handler in a vendor capable of a plurality of customer selectable transactions at different prices, said money handler having means for identifying the denomination of items of money deposited in the vendor, means for storing coins for use as change and means for issuing coins from the storage means in change in different amounts, comprising:

means for determining if the coin storage means contains at least a first predetermined amount of change, and for determining if the coin storage means contains at least a second predetermined amount of change, said second predetermined amount being larger than said first amount;

a vend control for permitting a vend;

logic means for determining the amount of credit accumulated as a result of each deposit of money in the vendor, for comparing the price of a selected transaction with the accumulated credit, and for governing said vend control, said means allowing a vend requiring more than the first predetermined amount of change only if an item of money of a denomination greater than the amount of change required has been deposited in the vendor; and means for determining if the coin storage means contains at least a third predetermined amount of change, said third predetermined amount being larger than said second amount, the logic means allowing a vend requiring more than the second predetermined amount of change only if an item of money of a denomination greater than the third predetermined amount of change has been deposited in the vendor.

8. A change return control as set forth in claim 7 wherein the first predetermined amount of change is 95¢, the second predetermined amount of change is $4.95, and the third predetermined amount of change is $9.95, whereby the logic means allows a vend requiring more than $4.95 change only if an item of money of at least ten dollars in denomination has been deposited in the vendor.

9. A change return control as set forth in claim 8 wherein the coin storage means includes a nickel change tube, a quarter change tube and a dollar change tube, wherein the amount of change determining means includes means disposed on the quarter change tube for sensing if at least three quarters are present in that tube, and means disposed on the dollar change tube for sensing if at least nine dollar coins are present in that tube.

10. A change return control as set forth in claim 9 wherein the amount of change determining means includes sensing means disposed on the quarter change tube for sensing if at least nineteen quarters are present in that tube.

11. A change return control as set forth in claim 9 wherein the amount of change determining means includes sensing means disposed on the dollar change tube for sensing if at least four dollars are present in that tube.

12. A change return control for a money handler in a vendor capable of a plurality of customer selectable transactions at different prices, said money handler having means for identifying the denomination of items of money deposited in the vendor, means for storing coins for use as change and means for issuing coins from the storage means in change in different amounts, comprising:

means for determining if the coin storage means contains at least a first predetermined amount of change, and for determining if the coin storage means contains at least a second predetermined amount of change, said second predetermined amount being larger than said first amount;

a vend control for permitting a vend;

logic means for determining the amount of credit accumulated as a result of each deposit of money in the vendor, for comparing the price of a selected transaction with the accumulated credit, and for governing said vend control, said means allowing a vend requiring more than the first predetermined amount of change only if an item of money of a denomination greater than the amount of change required has been deposited in the vendor; and display means for displaying to the customer the maximum amount of change that can be returned, the display means being reponsive to the coin storage means containing at least the first predetermined amount of change but less than the second predetermined amount to display the first predetermined amount as the maximum amount of change that can be returned.

13. A change return control as set forth in claim 12 further including means for determining if the coin storage means contains at least a third predetermined amount of change, said third predetermined amount being larger than said second amount, said display means being responsive to the coin storage means containing at least the second predetermined amount of change but less than the third predetermined amount to display the second predetermined amount as the maximum amount of change that can be returned.

14. A control system for a money handler in a vendor capable of a plurality of customer selectable transactions at different prices, said money handler being capable of accepting the deposit of a plurality of denominations of money, having means for identifying the denominations of items of money deposited in the vendor, having means for storing coins for use as change, and having means for issuing coins from the coin storage means in change in different amounts, comprising:

a vend control for permitting a vend;

logic means for determining the amount of credit accumulated as a result of each deposit of money in the vendor, for comparing the price of a selected transaction with the accumulated credit; and for governing said vend control, said logic means being responsive to the deposit of an item of money of a first predetermined denomination in the vendor and to the difference between the accumulated credit and the price of the selected transaction being at least as large as the first predetermined denomination to prevent the vend control from permitting a vend;

wherein the logic means includes means for preventing the vend control from permitting a vend if the difference between the accumulated credit and the price of the selected transaction is at least as large as the first predetermined denomination and no item of money larger in denomination than the first predetermined denomination has been deposited in the vendor.

15. A control system as set forth in claim 14 wherein the logic means is responsive to the deposit of an item of money of a second predetermined denomination for preventing the vend control from permitting a vend if the difference between the accumulated credit and the price of the selected transaction is at least as large as the second predetermined denomination, said second predetermined denomination being larger than said first predetermined denomination.

16. A control system as set forth in claim 15 wherein the logic means is responsive to the difference between the accumulated credit and the price of the selected transaction being at least as large as the third predetermined denomination to prevent a vend, said third predetermined denomination being larger than said second predetermined denomination.

17. A change return control for a money handler in a vendor capable of a plurality of customer selectable transactions at different prices, said money handler having means for storing coins for use as change and having means for issuing coins from the coin storage means in change in different amounts, comprising:

means for determining if the coin storage means contains at least a first predetermined amount of change, and for determining if the coin storage means contains at least a second predetermined amount of change; and display means for displaying to the customer the maximum amount of change that can be returned, the display means being responsive to the coin storage means containing at least the first predetermined amount of change but less than the second predetermined amount to display the first predetermined amount as the maximum amount of change that can be returned.

18. A change return control as set forth in claim 17 wherein the coin storage means includes a plurality of change tubes, wherein the amount of change determining means includes first sensing means for sensing the presence of the first predetermined amount of change and second sensing means for sensing the presence of the second predetermined amount of change.

19. A change return control as set forth in claim 18 wherein the first sensing means includes a first optoelectronic sensor assembly and the second sensing means includes a second optoelectronic sensor assembly.

20. A change return control as set forth in claim 18 wherein the first predetermined amount of change is 95¢ and the second predetermined amount is $4.95, wherein the coin storage means includes a nickel change tube and a quarter change tube, wherein the first sensing means includes means for sensing if at least three quarters are present in the quarter change tube and for sensing if at least four nickels are present in the nickel change tube, whereby if the coin storage means contains at least 95¢ available as change but less than $4.95 the display means displays 95¢ as the maximum amount of change that can be returned.

21. A change return control as set forth in claim 20 wherein the second sensing means includes means for sensing if at least nineteen quarters are present in the quarter change tube.

22. A change return control as set forth in claim 21 wherein the coin storage means includes a dollar change tube, further including third sensing means for sensing if at least four dollars are present in the dollar change tube.

23. A change return control as set forth in claim 20 wherein the coin storage means includes a dollar change tube and wherein the second sensing means includes means for sensing if at least four dollars are present in the dollar change tube.

24. A change return control as set forth in claim 18 including means for determining if the coin storage means contains at least a third predetermined amount of change, said third amount being larger than said second amount, wherein the display means includes means for displaying the second predetermined amount as the maximum amount of change that can be returned if the coin storage means contains at least the second predetermined amount of change but less than the third predetermined amount.

25. A change return control as set forth in claim 24 wherein the first predetermined amount of change is 95¢, the second predetermined amount is $4.95, and the third predetermined amount is $9.95, whereby if the coin storage means contains at least $4.95 available as change but less than $9.95 the display means displays $4.95 as the maximum amount of change that can be returned.

26. A change return control as set forth in claim 25 wherein the coin storage means includes a nickel change tube, a quarter change tube and a dollar change tube, wherein the first sensing means includes means for sensing if at least three quarters are present in the quarter change tube and for sensing if at least four nickels are present in the nickel change tube, further including dollar sensing means for sensing if at least nine dollars are present in the dollar change tube.

27. A change return control for a money handler in a vendor capable of a plurality of customer selectable transactions at different prices, said money handler being capable of accepting the deposit of a plurality of denominations of money, having means for identifying the denominations of items of money deposited in the vendor, having means for storing coins for use as change, and having means for issuing coins from the coin storage means in change in different amounts, comprising:

means for determining if the coin storage means contains at least a first predetermined amount of change, and for determining if the coin storage means contains at least a second predetermined amount of change, said second predetermined amount of change being larger than said first amount;

a vend control for permitting a vend;

display means for displaying to the customer the maximum amount of change that can be returned, the display means being responsive to the coin storage means containing at least the first predetermined amount of change but less than the second predetermined amount to display the first predetermined amount as the maximum amount of change that can be returned; and logic means for determining the amount of credit accumulated as a result of each deposit of money in the vendor, for comparing the price of a selected transaction with the accumulated credit, and for governing the vend control, said logic means being responsive to the deposit of an item of money of a first predetermined denomination in the vendor and to the difference between the accumulated credit and the price of the selected transaction being at least as large as the first predetermined denomination to prevent the vend control from permitting a vend, said logic means allowing a vend requiring more than the first predetermined amount of change only if an item of money of a denomination greater than the second predetermined amount of change has been deposited in the vendor, and said logic means allowing the vend control to permit a vend if the coin storage means contains at least the first predetermined amount of change and if the difference between the accumulated credit and the price of the selected transaction is no greater than said first predetermined amount of change irrespective of whether the coin storage means contains the second predetermined amount of change.

* * * * *